US005645085A

United States Patent [19]

Mengoli et al.

[11] Patent Number: 5,645,085

[45] Date of Patent: Jul. 8, 1997

[54] METHOD AND MACHINE FOR SIMULTANEOUSLY PRODUCING A NUMBER OF CIGARETTE RODS

[75] Inventors: Fausto Mengoli, Sasso Marconi; Fiorenzo Draghetti, Medicina, both of Italy

[73] Assignee: G.D Societa' Per Azioni, Bologna, Italy

[21] Appl. No.: 686,511

[22] Filed: Jul. 26, 1996

[30] Foreign Application Priority Data

Jul. 27, 1995 [IT] Italy ..... B095A0369

[51] Int. Cl.[6] ..... A24C 5/24

[52] U.S. Cl. ..... 131/67

[58] Field of Search ..... 131/35, 37, 67, 131/69, 84.1–84.4, 280

[56] References Cited

U.S. PATENT DOCUMENTS 2,148,685 2/1939 Di Ianni ..... 131/69 X 3,400,007 9/1968 Rudszinat ..... 131/67 X 4,336,812 6/1982 Seragnoli ..... 131/67 X 4,917,118 4/1990 Mangiarotti ..... 131/84.1 X

*Primary Examiner*—Jennifer Bahr

*Attorney, Agent, or Firm*—Oblon, Spivak, McClelland, Maier & Neustadt, P.C.

[57] ABSTRACT

A method and machine whereby at least two strips of paper, after being supplied with respective continuous layers of shredded tobacco, are fed along a forming beam by respective conveyor belts which are deformed transversely to gradually wind the respective strips about the respective layers and so form respective tubular wrappings, each presenting a respective longitudinal lateral appendix, an inner lateral portion of which is gummed by a respective gumming device and then brought into contact with an outer surface of the respective tubular wrapping to form a respective continuous cigarette rod; the inner lateral portions of the appendixes all facing the same way, and being gummed at an intermediate point of the forming beam.

29 Claims, 5 Drawing Sheets

Fig. 3a
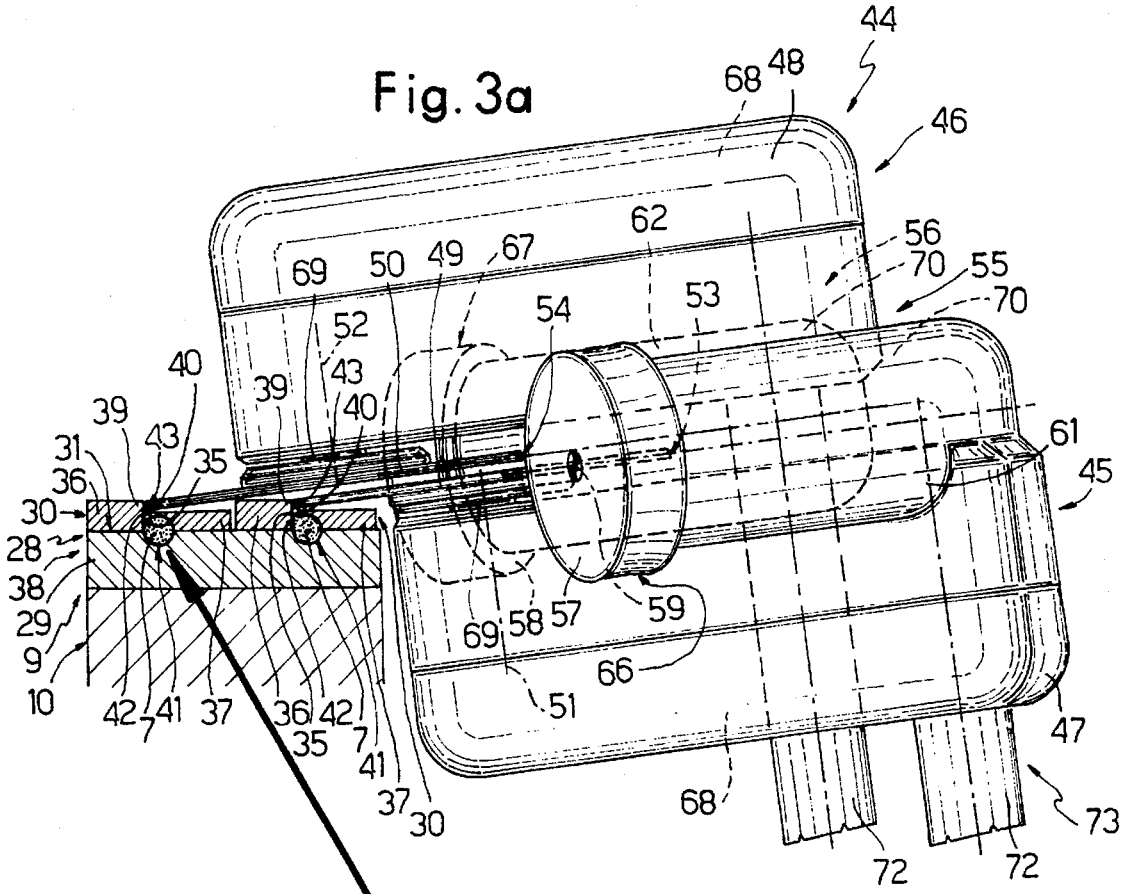
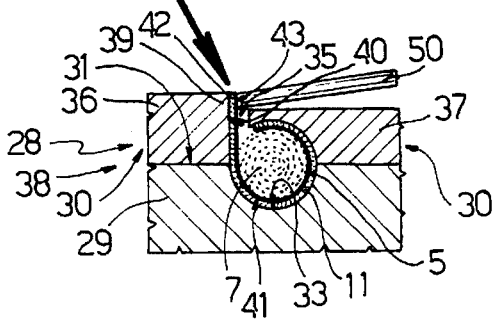
Fig. 3b

METHOD AND MACHINE FOR SIMULTANEOUSLY PRODUCING A NUMBER OF CIGARETTE RODS

BACKGROUND OF THE INVENTION

The present invention relates to a method of simultaneously producing a number of cigarette rods.

In cigarette manufacturing machines, and as described in U.S. Pat. No. 4,336,812, at least two parallel, side by side strips of paper are fed on to respective conveyor belts, the transportation branches of which extend over a forming bed and through a loading station where a central portion of each strip is fed with a respective continuous layer of shredded tobacco. Downstream from the loading station, the transportation branches of the conveyor belts engage respective variable-section grooves formed along a forming beam fitted to the forming bed, and are deformed transversely by the grooves to gradually wind the respective strips about the respective layers of tobacco to form respective tubular wrappings. Each of the wrappings presents a respective longitudinal lateral appendix, the inner surface of which is gummed by a respective gumming device and then brought into contact with the outer surface of the tubular wrapping to form a respective continuous cigarette rod.

As described in U.S. Pat. No. 4,336,812 referred to above, the inner surfaces of said appendixes face opposite ways to simplify as far as possible the assembly and maintenance of said gumming devices. Such an arrangement, however, seriously complicates any intervention on the forming bed on the part of the operator, as well as the assembly of removable safety covers on the outward-facing part of the forming bed.

To overcome this drawback, the gumming devices are therefore known to be located upstream from the loading station. Even this solution, however, is not without drawbacks, in that, on reaching the loading station, each paper strip presents a lateral portion gummed on the side facing the respective layer of tobacco, so that any stray particles of tobacco from the layer may adhere to the gummed portion of the strip, thus resulting in the formation of defective cigarettes.

SUMMARY OF THE INVENTION

It is an object of the present invention to provide a method of producing a number of continuous cigarette rods, designed to overcome the aforementioned drawbacks.

More specifically, it is an object of the present invention to provide a method of producing a number of continuous cigarette rods, while at the same time enabling free access by the operator to the rod forming bed.

Yet a further object of the present invention is to provide a method enabling the structure of the gumming devices to be simplified and combined as far as possible.

According to the present invention, there is provided a method of simultaneously producing a number of cigarette rods, the method comprising the steps of feeding at least two strips of paper, by means of respective conveyor belts, along a given path extending in a given traveling direction through a loading station, each conveyor belt coming into contact with an outer surface of the relative strip; transferring a respective continuous layer of tobacco on to an inner surface of each said strip at the loading station; feeding the strips and respective layers, by means of said conveyor belts, along a forming beam; gradually deforming the conveyor belts transversely, by means of the forming beam, to gradually wind the respective strips about the respective layers and so form respective tubular wrappings presenting respective longitudinal lateral appendixes projecting outwards and presenting respective longitudinal lateral inner surface portions; gumming, on each strip and by means of a respective gumming device, a lateral surface portion corresponding to the relative said lateral inner surface portion; and turning said appendixes over on to the respective tubular wrappings to form respective continuous cigarette rods; characterized in that the strips are deformed transversely so as to form respective said appendixes with their lateral inner surface portions all facing the same way; said lateral inner surface portions being gummed at an intermediate point of the forming beam by means of respective gumming devices located on the same side of the forming beam.

The present invention also relates to a machine for simultaneously producing a number of cigarette rods.

According to the present invention, there is provided a machine for simultaneously producing a number of cigarette rods, the machine comprising a forming beam for forming at least two cigarette rods; and, for each said cigarette rod, a conveyor belt which is brought into contact with an outer surface of a respective strip of paper, and feeds the strip along a given path extending at least partly along said forming beam; a loading station located along said path and upstream from the forming beam in a traveling direction of the conveyor belts; supply means for transferring a respective continuous layer of tobacco on to an inner surface of each said strip at the loading station; and a gumming unit comprising, for each conveyor belt, a gumming device for gumming a lateral surface portion of each strip; the forming beam presenting, for each said conveyor belt, a variable-section groove engaged by the conveyor belt and for gradually deforming the conveyor belt transversely to gradually wind the respective strip about the respective layer of tobacco so as firstly to form a respective tubular wrapping presenting a longitudinal lateral appendix projecting outwards and presenting a longitudinal lateral portion of said inner surface corresponding to said lateral surface portion, and so as secondly to turn said appendix over on to the respective tubular wrapping; characterized in that said grooves are substantially identical, for transversely deforming the respective strips in such a manner that said appendixes are arranged with their lateral inner surface portions all facing the same way; the gumming devices being located at an intermediate point of the forming beam and on the same side of the forming beam.

BRIEF DESCRIPTION OF THE DRAWINGS

A number of non-limiting embodiments of the present invention will be described by way of example with reference to the accompanying drawings, in which:

FIG. 3 shows a partly sectioned elevation of the FIG. 2 detail;

DETAILED DESCRIPTION OF THE INVENTION

Figure 1:
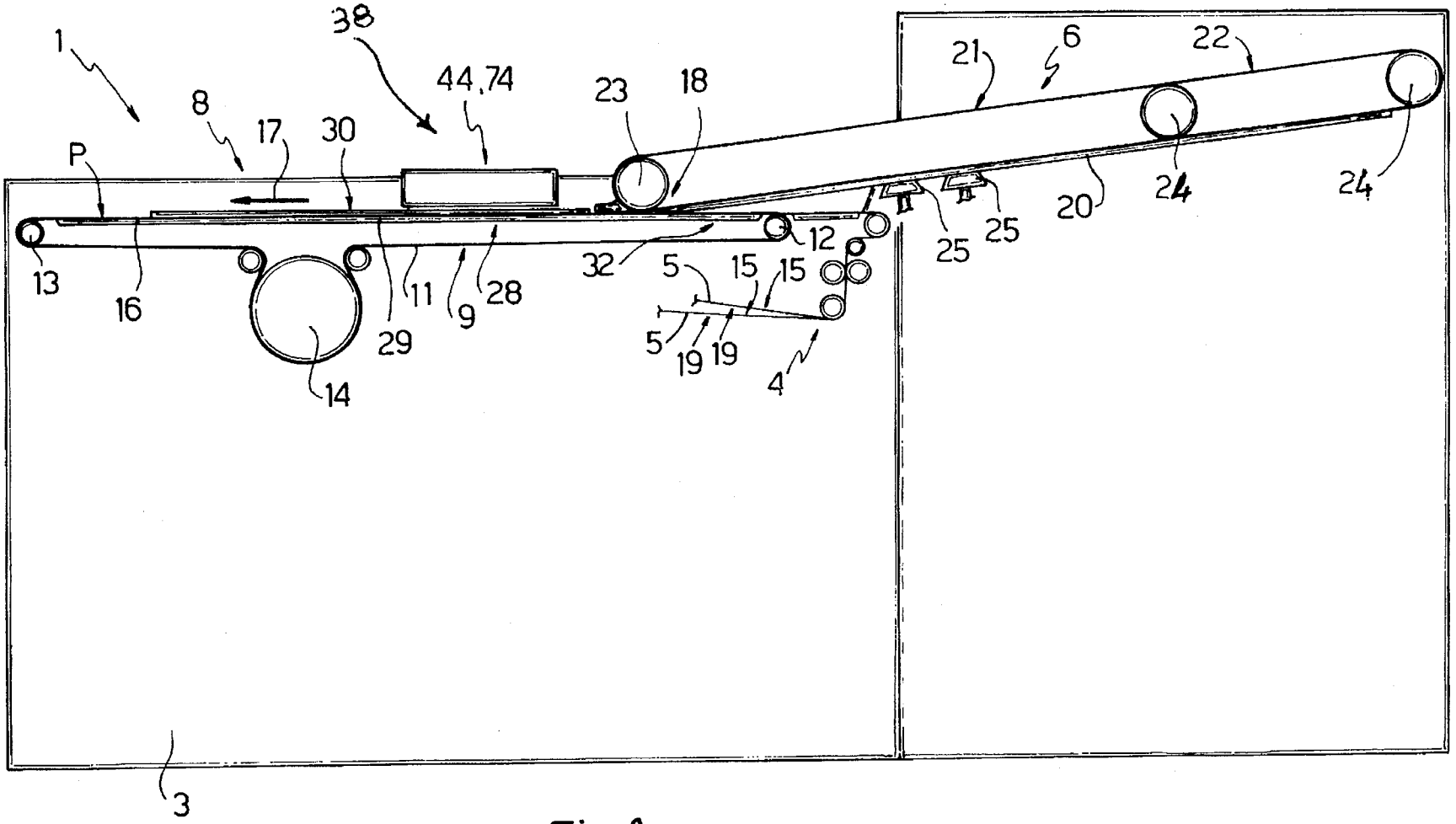
FIG. 1 shows a schematic side view, with parts removed for clarity, of a preferred embodiment of the machine according to the present invention.
Figure 2:
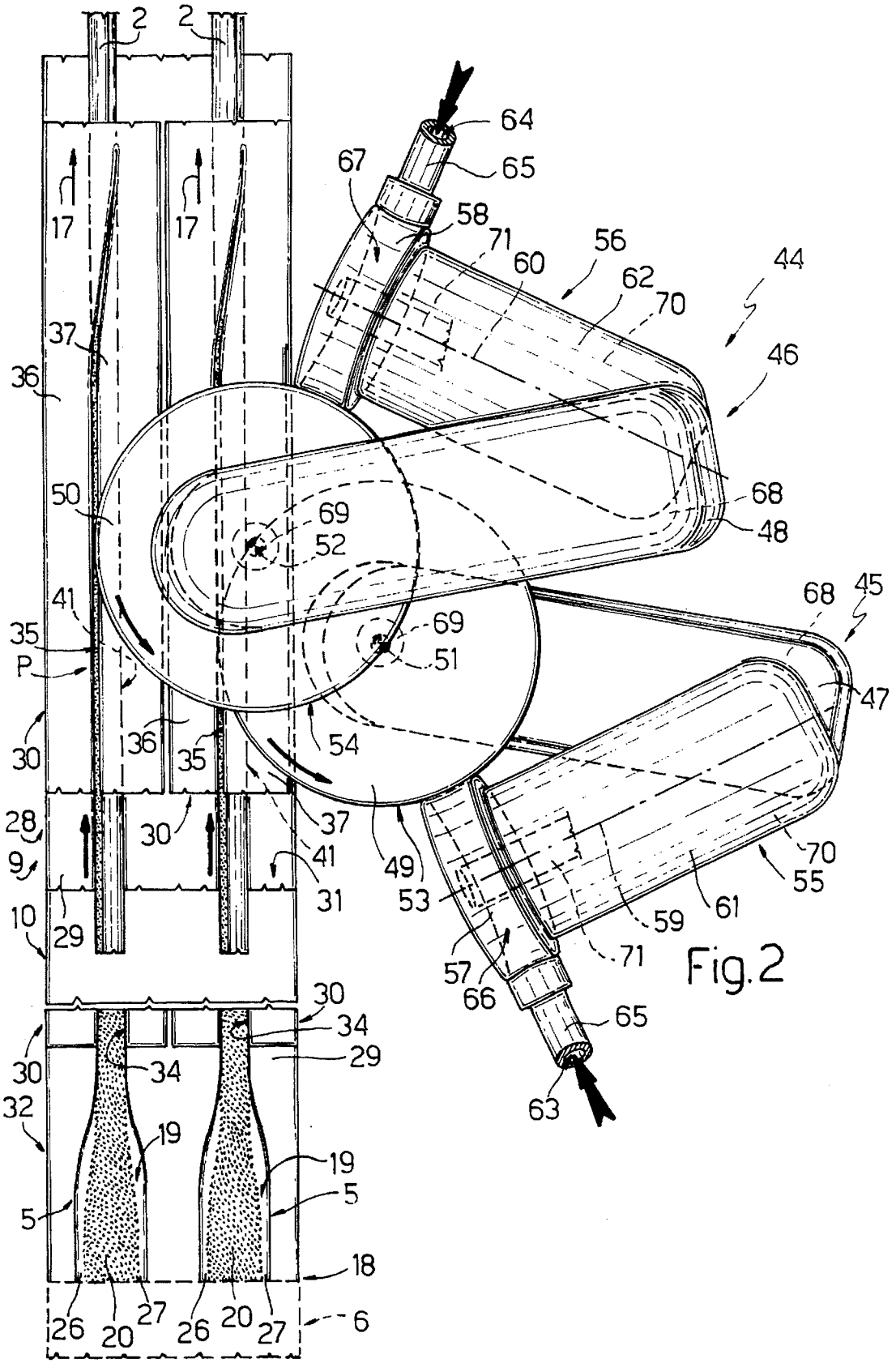
FIG. 2 shows a plan view of a first embodiment of a detail in FIG. 1.

Number 1 in FIG. 1 indicates a manufacturing machine for simultaneously producing at least two cigarette rods 2 (FIG. 2). Machine 1 comprises a supporting frame 3 supporting a known device 4 for supplying at least two paper strips 5, each slightly wider than the circumference of cigarette rods 2; a known device 6 for supplying shredded tobacco 7; and a device 8 for forming cigarette rods 2, and in turn comprising a forming bed 9 located at the top of frame 3 and presenting a free lateral surface 10 (FIG. 2) located at the front in relation to the operator (not shown) controlling machine 1, and which hereinafter is referred to as "front surface 10." Device 8 also comprises, for each strip 5, a conveyor belt 11 looped about two pulleys 12 and 13 and powered by a drive cylinder 14 to feed respective strip 5 along a given path P extending along bed 9.

Device 4 feeds each strip 5 on to respective belt 11 in such a manner that the outer surface 15 of strip 5 contacts the transportation branch 16 of belt 11, which feeds strip 5 in a given traveling direction 17 and through a loading station 18 located along path P and where a respective substantially uniform layer 20 (FIG. 2) of tobacco 7 is fed by device 6 on to the inner surface 19 of strip 5.

Layers 20 are substantially identical, and adhere to the bottom surface of the bottom branch of respective suction conveyor belts 21, 22 forming part of device 6 and extending partly over bed 9. Each conveyor belt 21, 22 slopes downwards and is looped about a bottom pulley 23 at station 18 and about a top pulley 24. Device 6 also comprises two known shaving disks 25 for shaving the bottom surface of layers 20, which are substantially narrower than respective strips 5. More specifically, and as shown in FIG. 2, when deposited on to respective strip 5, each layer 20 leaves two lateral portions 26 and 27 of inner surface 19 of strip 5 exposed.

Device 8 for forming cigarette rods 2 also comprises a forming beam 28 supported on bed 9 and extending along path P, downstream from station 18 in direction 17. As shown more clearly in FIGS. 2 and 3, beam 28 comprises a bottom plate 29 and, for each belt 11, a top plate 30 supported on the top surface 31 of plate 29. More specifically, plate 29 is longer than plate 30, and presents a perfectly flat initial portion 32 projecting in relation to plate 30, located adjacent to station 18, and contacting the bottom surfaces of transportation branches 16 of belts 11.

Further away from station 18 along path P, plate 29 presents, for each belt 11, an upper groove 33 extending along path P, beneath respective belt 11, and which, in relation to surface 31, gets gradually deeper to assume a curved section with a radius of curvature varying in inverse proportion to the distance from station 18; which section eventually assumes a constant, substantially semicylindrical shape with a radius of curvature substantially equal to that of cigarette rods 2. Each plate 30 on the other hand presents a respective recess 34 extending along respective groove 33, and which, as of station 18, gets gradually narrower until it is eventually reduced to a straightforward vertical slit 35 defined by two lateral walls 36 and 37. Downstream from station 18 and at an intermediate portion 38 of beam 28, wall 36 presents a respective end portion 39 projecting upwards in relation to wall 37, and in turn presenting an inner surface 40 facing frame 3. Grooves 33 are substantially identical, and surfaces 40 of walls 36 both face frame 3 on the opposite side to front surface 10 of bed 9.

Transportation branch 16 of each belt 11 extends along respective groove 33, in contact with which, branch 16 is gradually curved inwards until, cooperating with respective recess 34, it eventually assumes a substantially cylindrical shape. As a consequence of the transverse deformation of branches 16, respective strips 5 are also deformed transversely, and are wound about respective tobacco layers 20 to form respective tubular wrappings 41, each of which presents a lateral appendix 42 projecting outwards through respective slit 35, and in turn presenting a surface 43 facing away from front surface 10 and forming a longitudinal lateral portion of surface 19 corresponding to respective lateral portion 26.

Device 8 also comprises a gumming unit 44 supported on frame 3, to the side of and at intermediate portion 38 of beam 28, and on the opposite side to front surface 10 of beam 28. Gumming unit 44 provides for gumming surfaces 43 of appendixes 42, which, immediately downstream from unit 44, are turned over in known manner on to respective surfaces 15 to which they adhere to form respective cigarette rods 2.

Unit 44 comprises two gumming devices 45 and 46, each associated with a respective cigarette rod 2, and each of which provides for depositing an adhesive substance (not shown) on to respective surface 43.

Devices 45 and 46 comprise respective box elements 47 and 48 located substantially one over the other and respectively below and above surface 31; and respective gumming disks 49 and 50 fitted to respective elements 47 and 48, located facing each other over element 47 and beneath element 48 respectively, and slightly offset in relation to each other along path P. Disks 49 and 50 are identical, are positioned parallel to each other over surface 31, and are inclined towards surface 31 and front surface 10 so as to rotate, e.g. anticlockwise in FIG. 3, about respective axes 51 and 52 parallel to each other and inclined in relation to surface 31. Disks 49 and 50 are defined externally by respective conical lateral surfaces 53 and 54 coaxial with respective axes 51 and 52 and tangent to respective surfaces 43.

Unit 44 also comprises two devices 55 and 56 associated respectively with gumming devices 45 and 46, and for respectively supplying devices 45 and 46 with said adhesive substance. More specifically, devices 55 and 56 comprise respective gumming rollers 57 and 58 presenting respective axes 59 and 60 crosswise to respective axes 51 and 52, and which are supported for rotation about respective axes 59 and 60 by respective tubular appendixes 61 and 62, the first extending laterally from element 47 and upstream in relation to direction 17, and the second extending from element 48 and downstream in relation to direction 17. Rollers 57 and 58 present respective curved lateral surfaces 66 and 67 coaxial with respective axes 59 and 60, and which are supplied with said adhesive substance by respective outlet conduits 63 and 64 of a known dispensing device 65 common to devices 55 and 56. Surfaces 66 and 67 are positioned contacting respective surfaces 53 and 54 to apply surfaces 53 and 54 with said adhesive substance.

Each device 45, 46 comprises a known mechanical transmission 68 housed inside box element 47, 48 and presenting an output defined by a shaft 69 fitted with disk 49, 50; and a mechanical transmission 70 presenting an output defined by a shaft 71 fitted with roller 57, 58. Each pair of transmissions 68 and 70 presents a common input comprising a single shaft 72, which, together with shaft 72 of the other of devices 45 and 46, defines the output of a known actuating assembly 73 for simultaneously activating disks 49, 50 and rollers 57, 58 so that the directions of the tangential velocities of disks 49 and 50 at the points of contact with respective surfaces 43 are opposite to the traveling direction 17 of respective strips 5.

Operation of machine 1 is clearly discernible from the foregoing description and therefore requires no explanation. It should be pointed out, however, that the arrangement of gumming unit 44 greatly simplifies any intervention on forming bed 9 on the part of the operator, as well as the assembly of removable safety covers (not shown) on the front surface 10 side of bed 9. Moreover, the specific location of unit 44 along forming beam 28 provides for gumming the lateral portions 26 of the two strips 5 downstream from station 18, and so preventing the formation of defective cigarettes (not shown) due to shreds of tobacco of respective layers 20 adhering to lateral portions 26.

Figure 4:
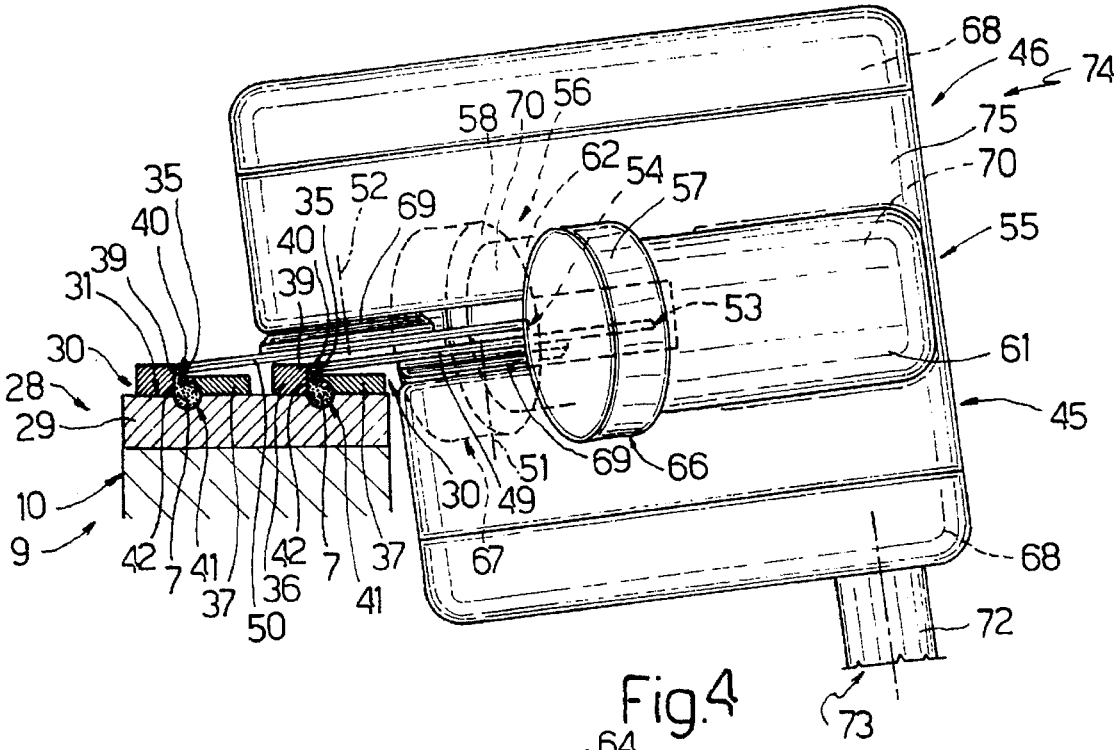
FIG. 4 shows the same view as in FIG. 3, of a first variation of the detail in FIGS. 2 and 3.
Figure 5:
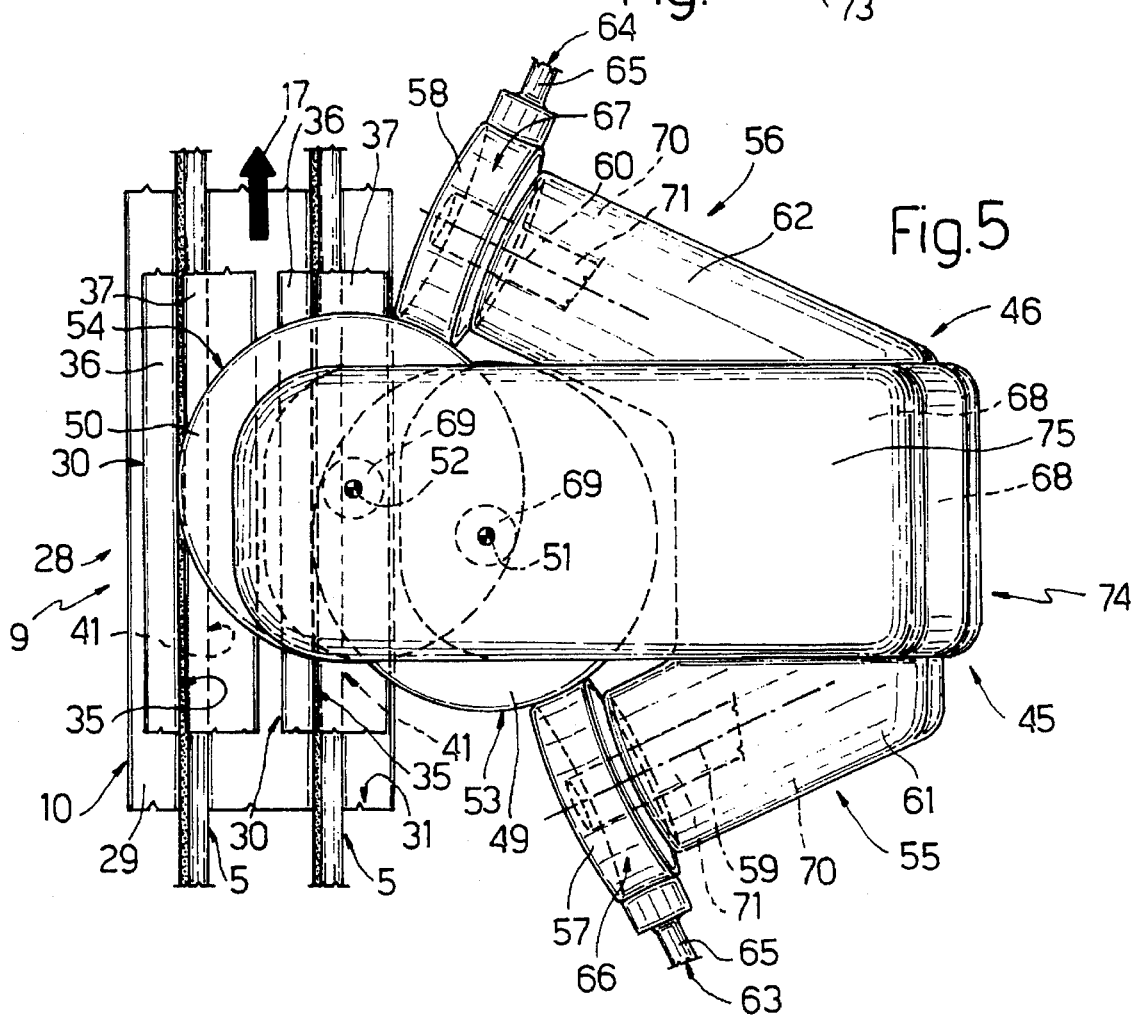
FIG. 5 shows a plan view of the FIG. 4 detail.

The variation shown in FIGS. 4 and 5 relates to a gumming unit 74 substantially similar to unit 44, except that, in this case, elements 47 and 48 are combined into a single box element 75 enclosing two transmissions 70 located substantially one over the other on opposite sides of surface 31, and slightly offset in relation to each other in a direction perpendicular to direction 17. Moreover, the two pairs of transmissions 68 and 70 are activated by an actuating assembly 73, which, unlike actuating assembly 73 of unit 44, presents one output shaft 72 connected to all four transmissions of unit 74.

The above arrangement provides for gumming surfaces 43 substantially at the same point of beam 28 along path P.

Figure 6:
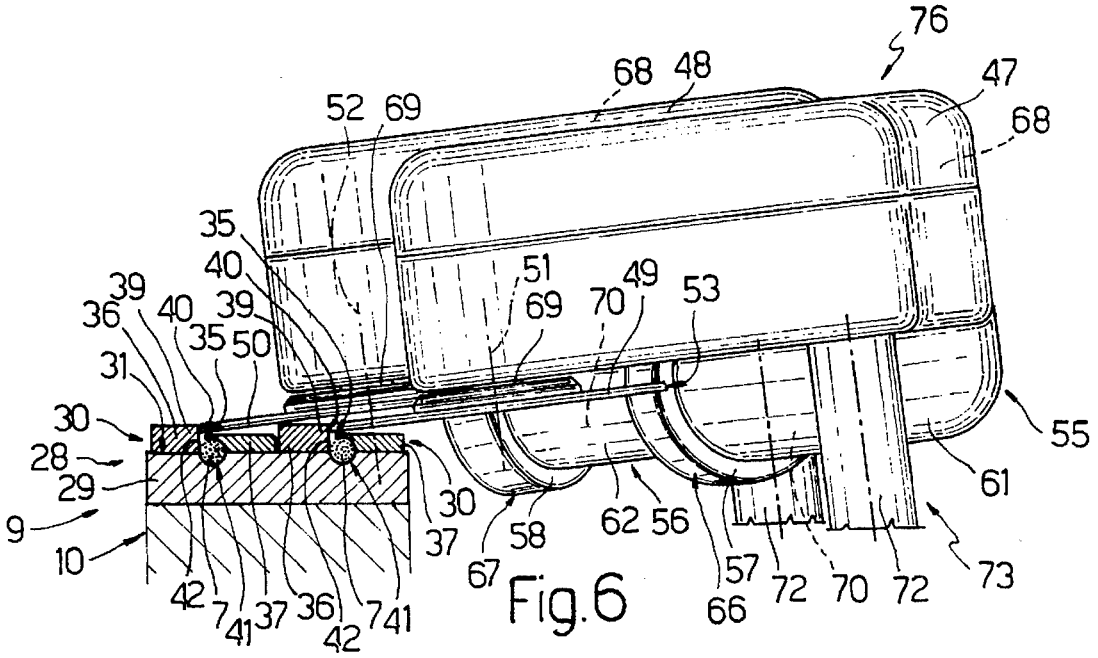
FIG. 6 shows the same view as in FIG. 3, of a second variation of the detail in FIGS. 2 and 3.
Figure 7:
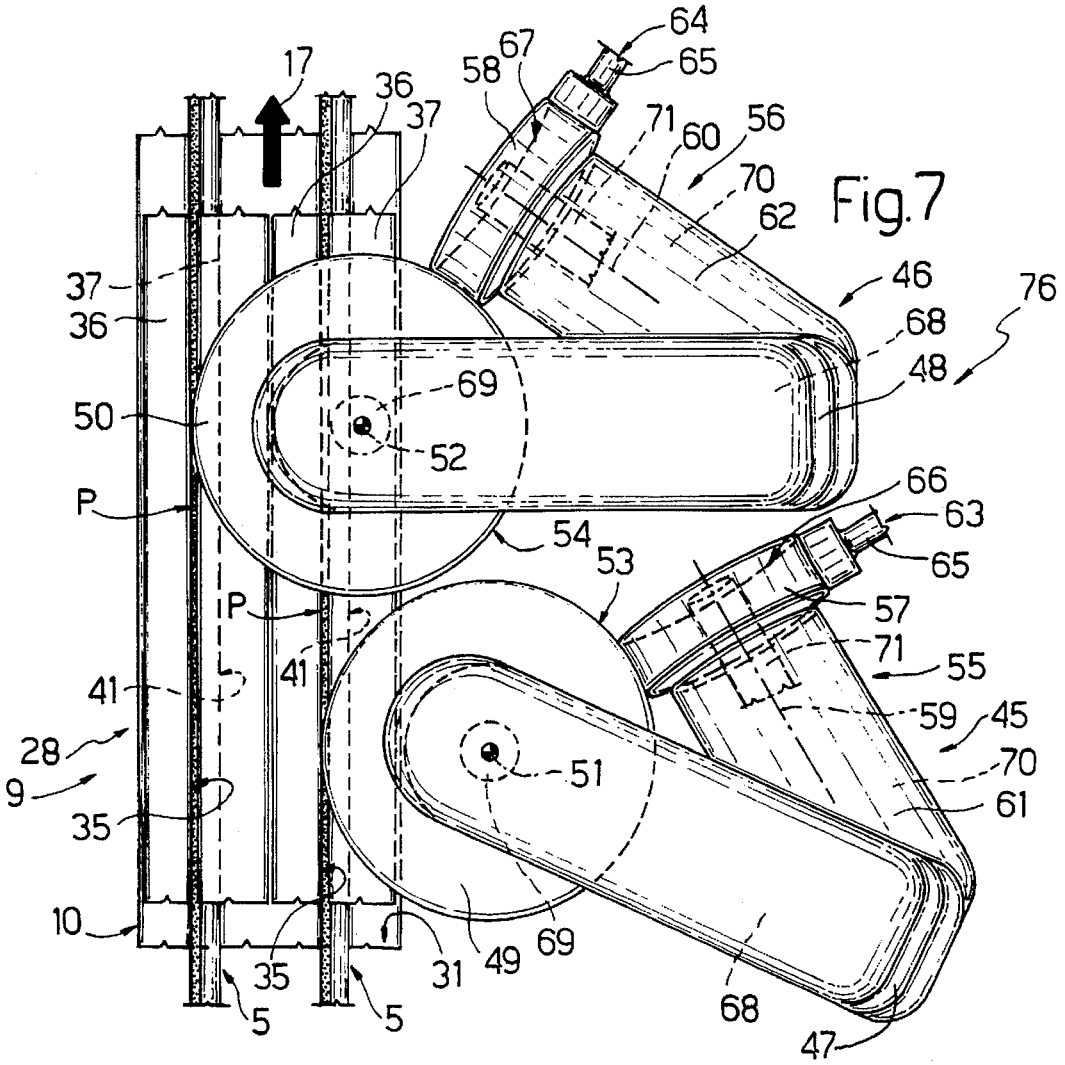
FIG. 7 shows a plan view of the FIG. 6 detail.

The variation shown in FIGS. 6 and 7 relates to a gumming unit 76 substantially similar to unit 44, except that, in this case, box elements 47 and 48, together with respective transmissions 70, are both located substantially over surface 31 and are offset in relation to each other along path P; appendixes 61 and 62 are both located on the same side of respective box elements 47 and 48; and, as opposed to being located one over the other, disks 49 and 50 are located substantially side by side and both beneath respective elements 47 and 48.

As such, gumming devices 45 and 46 present substantially the same structure, which not only provides for simplifying the design and manufacture of devices 45 and 46, but also for storing fewer spare parts.

We claim:

1. A method of simultaneously producing a number of cigarette rods (2), the method comprising the steps of feeding at least two strips (5) of paper, by means of respective conveyor belts (11), along a given path (P) extending in a given traveling direction (17) through a loading station (18), each conveyor belt (11) coming into contact with an outer surface (15) of the relative strip (5); transferring a respective continuous layer (20) of tobacco (7) on to an inner surface (19) of each said strip (5) at the loading station (18); feeding the strips (5) and respective layers (20), by means of said conveyor belts (11), along a forming beam (28); gradually deforming the conveyor belts (11) transversely, by means of the forming beam (28), to gradually wind the respective strips (5) about the respective layers (20) and so form respective tubular wrappings (41) presenting respective longitudinal lateral appendixes (42) projecting outwards and presenting respective longitudinal lateral inner surface portions (43); gumming, on each strip (5) and by means of a respective gumming device (45, 46), a lateral surface portion (26) corresponding to the relative said lateral inner surface portion (43); and turning said appendixes (42) over on to the respective tubular wrappings (41) to form respective continuous cigarette rods (2); characterized in that the strips (5) are deformed transversely so as to form respective said appendixes (42) with their lateral inner surface portions (43) all facing the same way; said lateral inner surface portions (43) being gummed at an intermediate point (38) of the forming beam (28) by means of respective gumming devices (45, 46) located on the same side of the forming beam (28).

2. A method as claimed in claim 1, characterized in that the strips (5) are so deformed transversely that the lateral inner surface portions (43) of said appendixes (42) face away from a front surface (10), substantially parallel to the forming beam (28), of a forming bed (9) supporting said forming beam (28).

3. A method as claimed in claim 2, characterized in that the gumming devices (45, 46) each comprise a gumming disk (49, 50), which is rotated with a lateral surface (53, 54) tangent to said lateral inner surface portion (43) of the relative said appendix (42); the gumming disks (49, 50) both being located over said forming beam (28), and extending on the opposite side of the forming beam (28) in relation to said front surface (10).

4. A method as claimed in claim 3, characterized in that each gumming disk (49, 50) is so rotated that, at a point of tangency of said gumming disk (49, 50) with said lateral inner surface portion (43) of the respective said appendix (42), said gumming disk (49, 50) presents a surface speed in the opposite direction to said traveling direction (17).

5. A method as claimed in claim 3, characterized in that said two gumming disks (49, 50) are inclined towards the forming beam (28) and towards said front surface (10).

6. A method as claimed in claim 5, characterized in that said gumming disks (49, 50) are identical.

7. A method as claimed in claim 5, characterized in that said gumming disks (49, 50) are substantially parallel to each other.

8. A method as claimed in claim 7, characterized in that said gumming disks (49, 50) are substantially coincident with each other along said path (P).

9. A method as claimed in claim 7, characterized in that said gumming disks (49, 50) are offset in relation to each other along said path (P).

10. A machine (1) for simultaneously producing a number of cigarette rods (2), the machine (1) comprising a forming beam (28) for forming at least two cigarette rods (2); and, for each said cigarette rod (2), a conveyor belt (11) which is brought into contact with an outer surface (15) of a respective strip (5) of paper, and feeds the strip (5) along a given path (P) extending at least partly along said forming beam (28); a loading station (18) located along said path (P) and upstream from the forming beam (28) in a traveling direction (17) of the conveyor belts (11); supply means (6) for transferring a respective continuous layer (20) of tobacco (7) on to an inner surface (19) of each said strip (5) at the loading station (18); and a gumming unit (44; 74; 76) comprising, for each conveyor belt (11), a gumming device (45; 46) for gumming a lateral surface portion (26) of each strip (5); the forming beam (28) presenting, for each said conveyor belt (11), a variable-section groove (33) engaged by the conveyor belt (11) and for gradually deforming the conveyor belt (11) transversely to gradually wind the respective strip (5) about the respective layer (20) of tobacco so as firstly to form a respective tubular wrapping (41) presenting a longitudinal lateral appendix (42) projecting outwards and presenting a longitudinal lateral portion of said inner surface (19) corresponding to said lateral surface portion (26), and so as secondly to turn said appendix (42) over on to the respective tubular wrapping (41); characterized in that said grooves (33) are substantially identical, for transversely deforming the respective strips (5) in such a manner that said appendixes (42) are arranged with their lateral inner surface portions (43) all facing the same way; the gumming devices (45, 46) being located at an intermediate point (38) of the forming beam (28) and on the same side of the forming beam (28).

11. A machine as claimed in claim 10, characterized in that said grooves (33) are so formed as to position said appendixes (42) with said lateral inner surface portions (43) facing away from a front surface (10), substantially parallel to the forming beam (28), of the machine (1).

12. A machine as claimed in claim 11, characterized in that the gumming devices (45, 46) each comprise a gumming disk (49, 50) presenting a lateral surface (53, 54) which, in use, is tangent to said lateral inner surface portion (43) of the respective said appendix (42); the gumming disks (49, 50) both being located over said forming beam (28), and extending on the opposite side of the forming beam (28) in relation to said front surface (10).

13. A machine as claimed in claim 12, characterized in that said two gumming disks (49, 50) are inclined towards the forming beam (28) and towards said front surface (10).

14. A machine as claimed in claim 12, characterized in that said gumming disks (49, 50) are identical.

15. A machine as claimed in claim 12, characterized in that said gumming disks (49, 50) are substantially parallel to each other.

16. A machine as claimed in claim 15, characterized in that said gumming disks (49, 50) are substantially coincident with each other along said path (P).

17. A machine as claimed in claim 15, characterized in that said gumming disks (49, 50) are offset in relation to each other along said path (P).

18. A machine as claimed in claim 12, characterized in that, in addition to said gumming disk (49; 50), each gumming device (45; 46) also comprises an actuating assembly (73); a first transmission (68) interposed between the actuating assembly (73) and the gumming disk (49; 50), and for rotating the gumming disk (49; 50) about an axis (51; 52); and dispensing means (55; 56) for supplying adhesive material on to said lateral surface (53; 54) of the gumming disk (49; 50).

19. A machine as claimed in claim 18, characterized in that said dispensing means (55; 56) comprise a gumming roller (57; 58) tangent to said lateral surface (53; 54) of the gumming disk (49; 50); and a second transmission (70) for rotating the gumming roller (57; 58) about an axis (59; 60) substantially crosswise to the axis (51; 52) of the gumming disk (49; 50).

20. A machine as claimed in claim 19, characterized in that said second transmission (70) is interposed between the gumming roller (57; 58) and said actuating assembly (73).

21. A machine as claimed in claim 20, characterized in that said actuating assembly (73) presents a respective output shaft (72) for each pair of transmissions (68, 70) defined by a said first (68) and a said second (70) transmission.

22. A machine as claimed in claim 20, characterized in that said actuating assembly (73) presents a single output shaft (72) common to all the pairs of transmissions (68, 70) defined by a said first (68) and a said second (70) transmission.

23. A machine as claimed in claim 18, characterized by comprising at least one casing (47, 48; 75) housing at least one said first transmission (68).

24. A machine as claimed in claim 23, characterized in that each said first transmission (68) is housed inside a respective said casing (47; 48); said casings (47, 48) being located on opposite sides of a surface (31) defined by said conveyor belts (11).

25. A machine as claimed in claim 24, characterized in that said casings (47, 48) are offset in relation to each other along said path (P).

26. A machine as claimed in claim 24, characterized in that said casings (47, 48) are located one over the other.

27. A machine as claimed in claim 25, characterized in that said second transmissions (70) extend laterally from respective said casings (47, 48) and respectively upstream and downstream in relation to said traveling direction (17) of said conveyor belts (11).

28. A machine as claimed in claim 23, characterized in that each said first transmission (68) is housed inside a respective said casing (47, 48); said casings (47, 48) being located over a surface (31) defined by said conveyor belts (11).

29. A machine as claimed in claim 28, characterized in that said second transmissions (70) extend laterally from respective said casings (47, 48) and on the same side of the respective said casings (47, 48).

* * * * *